US011536012B2

(12) United States Patent
Samain

(10) Patent No.: US 11,536,012 B2
(45) Date of Patent: Dec. 27, 2022

(54) SYSTEM FOR TREATING THE HAIR, TO BE CONNECTED TO A WATER INLET

(71) Applicant: L'OREAL, Paris (FR)

(72) Inventor: Henri Samain, Chevilly la Rue (FR)

(73) Assignee: L'OREAL, Paris (FR)

( * ) Notice: Subject to any disclaimer, the term of this patent is extended or adjusted under 35 U.S.C. 154(b) by 745 days.

(21) Appl. No.: 16/466,476

(22) PCT Filed: Dec. 22, 2017

(86) PCT No.: PCT/EP2017/084542
§ 371 (c)(1),
(2) Date: Jun. 4, 2019

(87) PCT Pub. No.: WO2018/122206
PCT Pub. Date: Jul. 5, 2018

(65) Prior Publication Data

US 2021/0285193 A1 Sep. 16, 2021

(30) Foreign Application Priority Data

Oct. 30, 2016 (FR) ..... 16 63539

(51) Int. Cl.
*E03C 1/046* (2006.01)
*A45D 19/02* (2006.01)
(Continued)

(52) U.S. Cl.
CPC ..... *E03C 1/046* (2013.01); *A45D 19/00* (2013.01); *A45D 19/005* (2021.01);
(Continued)

(58) Field of Classification Search
CPC ..... E03C 1/046; A45D 19/00; A45D 19/005; A45D 19/022; A45D 19/16;
(Continued)

(56) References Cited

U.S. PATENT DOCUMENTS 4,563,780 A 1/1986 Pollack
5,163,010 A 11/1992 Klein et al.
(Continued)

FOREIGN PATENT DOCUMENTS

EP 0 443 741 A1 8/1991
EP 1 240 845 A1 9/2002
(Continued)

OTHER PUBLICATIONS

International Search Report dated Feb. 12, 2018 in PCT/EP2017/084542 filed on Dec. 22, 2017.
(Continued)

*Primary Examiner* — Lori L Baker
(74) *Attorney, Agent, or Firm* — Oblon, McClelland, Maier & Neustadt, L.L.P.

(57) ABSTRACT

A system for treating the hair, to be connected to a water inlet, that includes at least one source of a cosmetic product, a water-dispensing device to convey the water to the hair, an adjustment device making it possible to inject, into the water, the product originating from the at least one source of product and to vary the content of product originating from this source in the water conveyed to the hair by the dispensing device and/or the amount of product conveyed to the hair by the dispensing device, this adjustment being able to assume at least one intermediate value between minimum and maximum content and/or amount values, a pressure booster to increase the pressure of the water at the inlet of the dispensing device beyond the pressure of the water at the inlet of the system.

24 Claims, 1 Drawing Sheet

(51) Int. Cl.

| | |
|---|---|
| ***A45D 19/00*** | (2006.01) |
| ***A45D 19/16*** | (2006.01) |
| ***B01F 35/83*** | (2022.01) |
| ***B01F 35/221*** | (2022.01) |
| ***B01F 101/21*** | (2022.01) |
| ***B01F 33/501*** | (2022.01) |

(52) U.S. Cl.
CPC ..... *A45D 19/022* (2021.01); *A45D 19/16* (2013.01); *B01F 35/2217* (2022.01); *B01F 35/831* (2022.01); *A45D 2200/057* (2013.01); *B01F 33/5011* (2022.01); *B01F 2101/21* (2022.01)

(58) Field of Classification Search
CPC ..... A45D 2200/057; A45D 19/10; B01F 35/2217; B01F 35/831; B01F 33/5011; B01F 2101/21
USPC ..... 239/310, 302, 319; 137/88, 268, 888, 137/896; 222/630
See application file for complete search history.

(56) References Cited

U.S. PATENT DOCUMENTS

| | | | | |
|---|---|---|---|---|
| 5,622,692 | A | 4/1997 | Rigg et al. | |
| 5,890,596 | A * | 4/1999 | Albisetti | B65D 81/3294 220/4.27 |
| 6,145,707 | A * | 11/2000 | Baudin | B65D 47/2031 222/189.09 |
| 2003/0065450 | A1 | 4/2003 | Leprince | |
| 2004/0153014 | A1 * | 8/2004 | Sage, Jr. | A61H 7/003 601/159 |
| 2006/0011746 | A1 | 1/2006 | De Simone | |
| 2008/0301869 | A1 | 12/2008 | Mock et al. | |
| 2009/0045268 | A1 | 2/2009 | Selander et al. | |
| 2010/0213279 | A1 | 8/2010 | Frederick | |
| 2011/0239363 | A1 | 10/2011 | Nagamatsu et al. | |
| 2013/0247295 | A1 | 9/2013 | Mock et al. | |
| 2016/0143408 | A1 | 5/2016 | Grez | |
| 2017/0051480 | A1 | 2/2017 | Farcet et al. | |
| 2021/0000317 | A1 * | 1/2021 | Giarritta | A47L 11/4041 |

FOREIGN PATENT DOCUMENTS

| | | | |
|---|---|---|---|
| FR | 3 020 250 | A1 | 10/2015 |
| JP | 2015-19669 | A | 2/2015 |
| WO | WO 2007/062536 | A2 | 6/2007 |

OTHER PUBLICATIONS

French Preliminary Search Report dated Aug. 30, 2017 in French Application 1663539 filed on Dec. 30, 2016.
Written Opinion dated May 11, 2020 in Singaporean Patent Application No. 11201904892W, 7 pages.

* cited by examiner

SYSTEM FOR TREATING THE HAIR, TO BE CONNECTED TO A WATER INLET

BACKGROUND OF THE INVENTION

The present invention relates to the field of treating hair, and more particularly, but not exclusively, to that of shampooing washes carried out in salons.

INTRODUCTION

People have characteristics of hair which differ from one person to the next. Thus, they need products to be adapted to the particular features of their hair.

Hairdressing salons need to carry out shampooing washes, generally before haircuts, hair styling, permanent wave, or after dyeing and bleaching operations.

The person who is in charge of this operation, hereinafter referred to as shampooer, seeks to optimize the use of their products to wash the clients' hair. Thus, he or she wishes to use the correct product with the correct level of washing, but also of treatment.

For the first aspect, he or she doses the amount of product to use, using a lot of product (more than 10 g for example) for a lot of hair, and less product for short hair. He or she also doses the amount depending on the degree of cleanliness of the hair, possibly for example applying more product or carrying out a succession of applications if the scalp is especially greasy. Thus, the shampooer tries to remove as much sebum as possible in order to cleanse the scalp and hair. On the contrary, if the client has a not very greasy scalp and/or washes their hair frequently, the shampooer may reduce the amount applied.

In these operations, the shampooer adjusts the amount of product, but rarely the formulation used. This is because it is difficult to know what is the best product to use based on a simple visual assessment of the situation. The shampooer therefore tends to use the same "normal" product and to vary the effect by adjusting the amount applied.

In this way, the shampooer solves the problem of washing but loses time, having to reapply products in some cases or having to spend a lot of time rinsing if the amount of shampoo applied is too great. Moreover, it is known that surfactants may, when they are used in too great an amount, become irritating. Thus, the shampooer may cause their client discomfort without wishing to do so.

There is also the problem of adapting the product to the quality of the hair. If the hair is damaged, it is preferable to use a product which is concentrated in care active agents, such as cationic polymers or carbon-based and/or silicone oils. Hair which is difficult to disentangle requires shampoos rich in cationic polymers and carbon-based oils. Hair which is coarse or dull (once dry) requires shampoos rich in silicone. The shampooer has difficulty knowing what is the best product based on their assessment, in particular when the hair is mixed (contains several levels of sensitization). As above, he or she tends to choose a standard product but he or she knows that he or she may incorrectly dose the treatment effect. He or she may then rectify this by applying a second product, but this operation also takes time.

In theory, it would be necessary for the shampooer to have a range of different products with higher or lower doses of surfactants, cationic polymers, and carbon-based or silicone oils. However, the number of combinations means that this is not very practical. Moreover, the shampooer must carry out several tests and keep that which is the most suitable on a client-by-client basis.

The problem also exists with conditioners. In general, conditioner is used when long or damaged hair has a disentangling problem. Yet, this problem depends on the quality and amount of hair but also on the shampoo used. A very basic shampoo, in the sense that it does not contain many, or any, cationic polymers, makes hair coarse after rinsing the shampoo. This problem is reduced if the shampoo contains cationic polymers. Thus, the shampooer must find the conditioner suited to their client and to the shampoo that he or she uses. In this way, in the event of an error in terms of using a poorly suited conditioner formulation, he or she may cause an inconvenience: If he or she has used an insufficiently treating conditioner, he or she must carry out another application of conditioner after the first. If he or she has used a conditioner which is too treating, the client risks having heavy hair which looks weighed down.

It is also known that some heads of hair require particular application procedures, involving a particular shampoo, and at least one second particular treatment, such as conditioner or pre-shampoo. The difficulty is first of all to find the best succession of products, then to remember this in order to use it again when the client returns. If it is possible to remember this, it is then necessary to find the products again and follow the procedure. This takes time, and because of this, in some salons, it is preferred not to seek these optimal successions.

Also, as it happens, it is customary to rinse between the application of two products, for example between shampoo and conditioner. The necessary rinsing time is not actually known. Thus, a lot of rinsing is often carried out whereas for some models this rinsing is not really necessary, or even beneficial.

Thus, there is a problem for the shampooer in choosing product, formula and amount to be used during the washing phase and during the care phase. In particular, a solution is sought which enables the shampooer to rapidly carry out the treatment without losing time rectifying when the product used has proven poorly suited, without risking the scalp of the client becoming irritated because of a shampoo containing too many surfactants, whether the hair is not treated enough, or too heavily treated, then presenting difficulties with disentangling, a coarse, dull, or weighed-down appearance.

A device making it possible to introduce a cosmetic product such as a soap into the supply of a shower head is known from US 2006/0011746 A1. An adjustment means makes it possible to vary the amount of product aspirated by Venturi effect to be mixed with the water.

US 2008/0301869 A1 discloses a device comprising a pressure booster to raise the pressure of the water before conveying it to a dispensing device. In one embodiment example, a source of soap (or of another product) is provided to deliver soap which is mixed with the water downstream of the pressure booster and upstream of the dispensing device. No adjustments of the amount of soap being mixed with the water is provided, other than all or nothing, namely the presence of soap or absence of soap in the water dispensed. In one variant, a source of soap is carried by the dispensing device.

U.S. Pat. No. 4,563,780 describes an automated bathroom making it possible to record different temperatures, water levels, and flow rates for various members of the family. A soap may be introduced into the water dispensed upstream of the faucets delivering water to the users.

BRIEF SUMMARY OF THE INVENTION

There is consequently a need to remedy this situation, and the invention aims to respond thereto by virtue of a system for treating the hair, to be connected to a water inlet, comprising:

at least one source of a product, a water-dispensing device to convey the water, optionally loaded with product, to the hair, an adjustment device making it possible to inject, into the water, the product originating from said at least one source of product and to vary the content of product originating from this source in the water conveyed to the hair by the dispensing device and/or the amount of product conveyed to the hair by the dispensing device.

Preferably, this adjustment may assume at least one intermediate value between minimum and maximum content and/or amount values. In other words, the adjustment is not all or nothing.

Preferably, the system also comprises a pressure booster to increase the pressure of the water at the inlet of the dispensing device beyond the pressure of the water at the inlet of the system.

The dispensing device which is supplied by a high-pressure water source by virtue of a pressure booster present upstream may comprise at least two nozzles which generate jets, preferably convergent jets, which collide in order to reduce the speed thereof and to transfer this kinetic energy into a reduction in the size of the droplets; this makes it possible to have a resultant jet which wets while having low water consumption; it is particularly advantageous to have low water consumption since this facilitates the dosing of the products used to treat the hair.

It is also particularly advantageous to have low water consumption for salons which are not connected to mains water supplies, or which are connected to sporadic mains water supplies.

It is also particularly advantageous to have low water consumption to reduce the effect of the water on the hair when the latter has been treated beforehand by treatments which have deposited an active compound such as a dye compound, disentangling compound, or shine-improving compound. These compounds are often sensitive to water and the use of a weak stream of water may limit the removal of these compounds.

By virtue of the invention, it is possible to vary the content of products in the water in real-time in order to facilitate, for the shampooer, the determination of the best washing and/or treatment for the hair of the person to be treated, without applying too much product and risking inconveniencing the person to be treated. The user may more readily determine the treatment suited to the hair of the person whose hair is treated, especially cleansed.

The system may comprise a user interface enabling said user:

to select a setting, the system being configured to act on the adjustment device as a function of the selected setting, and/or to input at least one item of information relating to a treatment result obtained with the selected setting.

The system may make it possible to vary a usage characteristic of a product. "Usage characteristic" should be understood to mean at least one condition of use of the product enabling it to exert its action: This may for example be the concentration of the product within a treatment solution distributed on the hair by the system, the amount of product used, the content thereof relative to another product used jointly, and/or a sequence of use of this product, especially if it is used before or after another product or with or without rinsing.

"Treatment result" should be understood to mean a result associated at least in part with the use of the product. This may be the degree of cleansing, the foaming strength, the speed of foaming, or a disentangling, smoothing, conditioning or care strength, etc.

The invention gives the shampooer the possibility to seek the best products for their client.

The invention enables the user to carry out adjustment tests, and once satisfied with the results, to record the products used and the conditions of use of these products, especially the amounts, concentrations and/or usage context, for example with or without rinsing or use of pre-shampoo or conditioner.

The information recorded may then be used to determine catalog products making it possible to reproduce the results or come close thereto, and/or to reproduce the treatment upon returning to the salon.

They may also make it possible to hone the treatment to come close to an optimal result, by noting, bit by bit, the change in the results as a function of the treatments. Thus, the system may be arranged to propose a new setting as a function on the one hand of recorded data relating to results previously observed and the corresponding treatment conditions, and on the other hand a request expressed by the client and/or the user and input into the system.

The system may be arranged to enable the user to input information thereon relating to the hair to be treated, for example length, consistency, colour, dyeing, relaxing or permanent-wave history, styling habits, regular use of heating systems, state of the hair, etc., and to take these indications into account in the proposals made of settings. The system may further use the information input to modify settings stored in memory for a given client, in order to take account of changes in their hair since the previous visit to the salon; for example, the system is arranged to modify the amounts of water and/or product(s) conveyed to the hair as a function of the change in the length thereof since the previous visit to the salon. For example, if the hair is shorter due to a haircut carried out after the last washing operation, the system may reduce the amounts of water and of products used. The system may be arranged to enable the shampooer to input an item of information regarding the length of the hair, for example the length in cm thereof. As a variant, the system is arranged to measure it automatically, by virtue, for example, of one or more sensors fitted in the sink.

The system may comprise a means to store at least one setting in memory. This may be an electronic or computer memory, for example a memory of SSD drive type, or hard drive or shared drive, commonly referred to as "cloud". The information may be stored in memory in the system itself, in a circuit board located close to the washing sink, or on a remote server, present in the salon or outside same. When the system is used to automatically or semi-automatically generate a setting based on data stored in memory, it is advantageous to give the system access to the salon's booking system so as to know the identity of the person treated from this booking system, which avoids having to input it into the system; in semiautomatic operation, the system may be arranged to display, on the user interface, the identity of the person as determined by accessing the booking system, in order to enable the shampooer to confirm this information before starting the treatment; it may also be preferable for the system to recall the treatment that it is preparing to carry out automatically, in order to enable the shampooer to input a confirmation.

The user interface may be arranged to make it possible to input at least two items of information, relating respectively to at least two different criteria for evaluating the result of the treatment, into the system. This may be a result during the treatment itself, for example the foaming strength and the speed of foaming, or a result obtained after rinsing but while the hair is still wet, for example the softness of the hair and the ability to disentangle it, or a result estimated when the hair is dry. The result may be estimated by the user visually and/or by touching with the fingers; the user may optionally have available one or more accessories or apparatus making instrument-based evaluation possible; in this case the apparatus used may be linked to the system to enable it to analyse the corresponding data. In this case, it is considered that the use of the apparatus by the shampooer equates to input by said shampooer of an item of information relating to a treatment result, even if this information input is carried out automatically.

The system preferably comprises a means for generating a product recommendation and/or a treatment recommendation at least based on the knowledge of the setting selected and of said at least one item of information input by the user relating to the treatment result. This means comprises, for example, a computer program which accesses product data containing information regarding results that different products make it possible to obtain on the hair, and also regarding the link between these products and the formulation tested on the person who is being treated.

The system is preferably arranged to enable the user to input a preference of the person treated regarding a result to be obtained. The system may then favor, in its recommendation, a product which makes it possible to obtain the desired result, compared to other criteria to be met.

The system is advantageously arranged to generate an indication regarding the conditions of use of a product, as a function of data previously input into the system, enabling it to anticipate the effect of a condition of use of a product on the result obtained; this is for example the system's knowledge of a variation in the treatment strength, for example disentangling strength, of a product as a function of the amount of water used for rinsing.

The system is advantageously arranged in order to control not only the amount of each product which is sent to the hair, but also the amount of water which is dispensed; knowledge of the amount of water dispensed may be useful especially when the water and the product(s) are dispensed on the hair while the outlet of the sink is closed, since this makes it possible to more readily determine the concentration of each product in the solution present in the sink.

The user interface is preferably produced so as to enable the user to modify numerous treatment parameters, in order to carry out a multitude of tests, and thereby to determine the best treatment conditions.

The adjustment device may thus be arranged to enable the proportion of a product in the dispensed solution to be controlled continuously or in steps, for example of 25% or less.

The adjustment device is preferably arranged so that the content of a product injected into the water may vary for example between 0.3 and 20% by weight, or even between 0.3 and 10%.

The system may be arranged to dispense an amount of a product and/or a product with a given concentration, selected by the user prior to the dispensing of the product, in order to test or to use a predefined formulation. For example, the user selects, on the user interface, the concentration of the product and the latter is dispensed with said concentration.

As a variant, the system is arranged to dispense at least one product with a concentration which is variable over time, especially during a session at the sink or from one appointment to another, so as to enable the user to carry out tests at different concentrations, or with different amounts, of product. When the concentration and/or the amount varies during the session at the sink during the same appointment, the user may make use of this to test the solution dispensed on several distinct parts of the hair, and determine, in light of a result on each of these parts of the hair, the concentration and/or the amount of product most suited to obtaining the desired result.

The system may be arranged to propose at least one program referred to as "wash test".

The system is then arranged such that, during the execution of such a program, the system conveys a variable proportion, for example an increasing proportion, of a product into the dispensing device. In this way, if the shampooer sees that the product is foaming correctly on the hair and/or washing correctly, he or she may stop the dispensing and/or identify the optimal point during this test program. The system may be arranged to store in memory the total amount of product conveyed, for example after carrying out an integration. The system may be arranged to subsequently propose several implementations with the same amount of product, but distributed according to different programming and/or over a different period of time. For example, the shampooer will have varied the injection of the product into the stream of water according to an increasing mode, starting from a proportion of product of 0% and regularly increasing the percentage by 0.25% every second. If the shampooer identifies that, after 16 seconds, the foam obtained is satisfactory, he or she may then stop the system. By integration, the system calculates that the amount of product injected during the test corresponds to a regular supply at 2% over 16 seconds. Starting from this information, the system will be able to propose several implementations:

- An equivalent implementation (from 0% to 4% in 16 seconds according to a mode increasing by 0.25% per second),
- another implementation such as a regular injection mode (for example, 2% for 16 seconds, 4% for 8 seconds),
- another implementation such as an increasing or decreasing injection mode but which is different from the mode used during the test.

The system may be arranged to propose, to the user, a program referred to as "wash test", consisting in conveying a variable proportion, for example an increasing or decreasing proportion, automatically or at the shampooer's request, of a product relative to another into pipes of the system with a view to dispensing it by the dispensing device. It is then possible for the shampooer to sense the proportion most satisfactory to him or her, for example by touching the hair during the conveying. In this way, if the shampooer sees that the product is foaming correctly on the hair and/or washing correctly, he or she may stop the test program and/or identify the optimal point. The system then retains the total amount of product conveyed, for example after carrying out an integration, and will then be able to propose several implementations with the same amount of product, but distributed according to different programming and/or over a different period of time, as mentioned above.

A program variant which may be proposed to the user by the system, consists in conveying two or more than two products in a given relative proportion into the pipes, and in increasing the proportion conveyed of a product relative to the other or the proportion of this mixture in the water, automatically or at the shampooer's request. It is then possible for the shampooer to sense the proportion most satisfactory to him or her, for example by touching the hair during the conveying. In this way, if the shampooer sees that the product is foaming correctly on the hair and/or washing correctly, he or she stops the program and/or identifies the optimal point. The system will then retain the satisfactory parameters, for example the total amount of the mixture of products conveyed, for example after carrying out an integration, and will then be able to propose several implementations with the same amount of product, distributed according to different programming and/or over a different period of time. For example, the shampooer will have varied the injection of two products into the stream of water according to an increasing mode for one and a regular mode for the other, starting from a proportion of product of 0% and regularly increasing the percentage by 0.25% every second for the first and by 4% for the second. If the shampooer identifies that, after 16 seconds, the foam obtained is satisfactory, he or she may then stop the system. By integration, the system calculates that the amount of product injected during the test corresponds to a regular supply at 2% over 16 seconds for the first and 4% over 16 seconds for the second. Starting from this information, the system will be able to propose conveying the two products in a 2/4 ratio under different implementations:

- an equivalent implementation (for the first product: from 0% to 4% in 16 seconds according to a mode increasing by 0.25% per second and for the second 4% over 16 seconds),
- other implementations such as, for example, a mode of regular injection of the two products in a 2/4 ratio.

The system preferably makes it possible to input information relating to the result obtained after the washing. In particular, the system may have information input relating to rinsing parameters, in order to be able to reuse them subsequently. The shampooer may then find the optimal rinsing depending on whether he or she wishes for the hair to be perfectly clear or to still carry some traces of product and thereby obtain an effect.

During rinsing, he or she may thus input information into the system relating to the quality of the hair and the speed of rinsing. The system may be arranged to take account thereof in order to modify settings or suggest testing new settings. The same applies during combing and an optional application of another shampoo, conditioner, mask, or other products, and other hair treatment steps such as haircutting, hair setting, blow drying, straightening, etc.

Thus, if the shampooer or the client or the hairdresser notices that the hair is too coarse, difficult to disentangle, too weighed-down, etc., it is possible to input information into the system immediately afterwards or later. The system is advantageously arranged to deduce therefrom modifications to be carried out or to propose for the setting; in addition, the choice by the system of the catalogue product(s) proposed to the client will advantageously be made by taking this information feedback into account.

The system is preferably suited to hair products other than shampoo. It is thus possible to dispense, by means of the dispensing device, products such as other surfactant-based or non-surfactant-based compositions, intended to provide a care effect, with or without washing effect, for example formulations referred to as "no-poo" or "low-poo", conditioners and masks, or formulations based on diluted surfactants, among other products.

The system may also be arranged to propose a program referred to as "care test". The system may then be arranged such that, during the execution of such a program, the system conveys a variable proportion, especially an increasing proportion, of a product into the pipes with a view to dispensing it via the dispensing device. In this way, if the shampooer sees that the product is caring well for the hair, he or she may stop the running of the program and/or identify the optimal point during the test program. The system then retains the total amount of product conveyed, for example after carrying out an integration, and is then able to propose several implementations with the same amount of product, but distributed according to different programming and/or over a different period of time, as mentioned above.

The system may further be arranged to propose another program consisting in conveying a variable proportion, for example an increasing or decreasing proportion, automatically or at the shampooer's request, of a product relative to another in the pipes. It is then possible for the shampooer to sense the proportion most satisfactory to him or her, for example by touching the hair during the conveying. In this way, if the shampooer sees that the distributed solution is caring well for the hair, he or she stops the test program and/or identifies the optimal point. The system will then retain the total amount of product conveyed, for example after carrying out an integration, and will then be able to propose several implementations with the same amount of product, but distributed according to different programming and/or over a different period of time, as mentioned above.

Another program consists in conveying two or more than two products in a given relative proportion into the pipes, and in increasing the proportion conveyed of this mixture in the water, automatically or at the shampooer's request. It is then possible for the shampooer to sense the proportion most satisfactory to him or her, for example by touching the hair during the conveying. In this way, if the shampooer sees that the product is caring well for the hair, he or she may stop the test program and/or identify the optimal point. The system will then retain the total amount of the mixture of products conveyed, for example after carrying out an integration, and will then be able to propose several implementations with the same amount of product, but distributed according to different programming and/or over a different period of time, as mentioned above.

The system preferably makes it possible to integrate information after applying a treatment solution.

In particular, the system may, automatically or non-automatically, have information input relating to rinsing parameters, in order to be able to reuse them subsequently. In particular, the system may be arranged to determine the amount of rinsing water used, and store this parameter in memory. The shampooer may then find the optimal rinsing depending on whether he or she wishes for the hair to be perfectly clear of product or to still carry some traces of product and thereby obtain an effect such as care, shine, etc.

In particular, during rinsing, he or she may thus input information into the system relating to the quality of the hair and the speed of rinsing. The system may then take account thereof in order to modify the settings, for example of water flow rate, or suggest testing new settings, for example carrying out the rinsing at a different flow rate. The same applies during combing and the application of a conditioner, mask, or other products, and other hair treatment steps such as haircutting, hair setting, blow drying, straightening, etc.

Thus, if the shampooer, the client or the hairdresser notices that the hair is too coarse, difficult to disentangle, too weighed-down, etc., it is possible to input information into the system immediately afterwards or later. The system may be arranged to deduce therefrom modifications to be carried out or to be proposed, by virtue of its knowledge of the effects of the products on the parameter that it is sought to correct.

It is possible to combine the application of one or more shampoos and one or more care products. In this case, use may be made of a "wash test" or "care test" program or else a specific program. By virtue of this approach, it is possible to bring together, in a single application, washing and care.

The system is advantageously arranged to make it possible to test a succession of products. Thus, a "succession test" program makes it possible, for example, to test one of the following sequences, or to test them successively during successive visits to the salon:

- a shampooing wash, a rinse, a care, a rinse,
- a shampooing wash, a care, a rinse,
- a pre-shampoo, a rinse, a shampooing wash, a rinse, a care, a rinse,
- a pre-shampoo, a shampooing wash, a rinse, a care, a rinse,
- a pre-shampoo, a rinse, a shampooing wash, a care, a rinse,
- a pre-shampoo, a shampooing wash, a care, a rinse,
- a pre-shampoo, a rinse, a shampooing wash, a rinse,
- a pre-shampoo, a shampooing wash, a rinse,
- a pre-shampoo, a rinse, a care, a rinse,
- a pre-shampoo, a care, a rinse.

By varying the different parameters of the treatment carried out at the sink, this approach makes it possible to find, and record, the sequence leading to the best results.

When a catalogue product is proposed by the system, this proposal may be accompanied by a recommendation regarding the use of this product, for example within a particular treatment sequence.

The system may be arranged to carry out tests on the hair with a different water flow rate than that which is used subsequently; this is facilitated by using a dispensing device with a low flow rate, such as that disclosed in the publication WO 2007/062536.

The system is then advantageously arranged to calculate, as a function of a new flow rate, for example adjusted by the user on the user interface, the amounts of products to convey to obtain an equivalent result. For example, a product test is carried out with a water flow rate of 0.5-1 l/min, and subsequently the treatments are carried out with another water flow rate, for example 1-4 l/min.

The system may be arranged to take into account, in the calculation of the amount of a product to inject into the water as a function of the water flow rate, the fact that at a higher water flow rate, a greater proportion of product is liable to be lost if it leaves through the sink outlet; thus, the system may be arranged to apply a law for correction of the amount as a function of the flow rate, which law is non-linear, to take into account the loss of product which increases with the flow rate; the system may further be arranged to compensate for the amount of product lost as a function of the flow rate by increasing the concentration of product in the treatment solution which is conveyed and/or by modifying the duration for which the solution is dispensed.

The system may be arranged to automatically control the opening or closing of the sink outlet as a function of the nature of the treatment; for example, during rinsing, the system orders the opening of the outlet; on the other hand, during the distribution of a predefined product, a conditioner for example, the system orders the closing of this outlet.

The system according to the invention enables the shampooer to optimize the nature of the products, the amounts applied and also the amount of rinsing water. It makes it possible to record the tests and optimal settings. The user may therefore improve performance beyond that which would have been possible by their skills of assessment.

The invention may make it possible for the user to reuse settings, to improve them and to adapt them to changes in the hair. This enables savings of time and of product. Moreover, since the user does not have to reproduce the settings during the client's subsequent visits, he or she subsequently takes only a very short amount of time to satisfy the client.

The invention also makes it possible to reduce water losses, when the system is created such that the information relating to optimal rinsing is retained and reused.

The invention further makes it possible for the user to test new mixtures and new treatment sequences, optimized for a given client or for testing on other clients. In one exemplary embodiment of the invention, the user shares this information, in particular via digital connections, to inform other salons.

Thus, another subject of the invention is a set of systems according to the invention, present in different salons, configured to share information with one another, especially relating to settings and/or sequences considered to be optimal for given types of heads of hair. The systems may especially communicate via a shared database which they may remotely interrogate and input information into.

The system may be arranged such that a given hairdresser may search a database, by means of the client's identification, for example by their name, by an email address, by a pseudonym, by a client number, etc., of a description of the hair, for example volume, length, ethnicity, etc., or of a description of a history, for example number of dyeing operations, use of dyes of brand Y, etc., in order to receive from the system, by comparison, a setting and/or treatment sequence proposal.

The invention may also serve for a salon or a shampooer to build up a professional identity, recognizable by the mixtures and successions that they provide.

The system may be arranged to make it possible, via the user interface, to input an item of information relating to the products for washing hair used by the client, in order to make it possible, by interrogating a database relating to these products, to generate a setting making it possible to reproduce the action of this product as closely as possible. This enables a client who is very satisfied with a product to have their hair treated at the sink in an equivalent way, on their request.

The system according to the invention may also have at least one of the characteristics listed below, or any combination thereof:

- the system comprises a means to store at least one setting in memory,
- the setting is stored in memory at the user's request,
- the setting is automatically stored in memory when a treatment result is input into the system,
- the user interface makes it possible to input at least two items of information, relating respectively to at least two different criteria for evaluating the result of the treatment, into the system,
- the system comprises a means for generating a product recommendation and/or a treatment recommendation at least based on the knowledge of the setting selected and of said at least one item of information input by the user relating to the treatment result,
- the system is configured to access a database containing information relating to an expected treatment result as a function of a selected setting, the system is arranged to compare a treatment result observed by the user and input into the system and the expected result determined by means of the database and to generate information relating to a modification of the setting and/or of the treatment as a function of this comparison, the system is configured to access a database giving information relating to the formulation of catalogue products and to identify one or more catalogue products as a function at least of the knowledge of at least one selected setting and of said at least one item of information input by the user relating to the observed treatment result, such that the product(s) identified provide a result which comes close to that obtained, the database gives information relating to one or more characteristics of the listed products, especially chosen from speed of foaming, speed of rinsing, detergent strength, disentangling strength, the system is configured to access a database giving information relating to an available stock of catalogue products and to generate the product recommendation as a function of the products available in stock, the system comprises a device which dispenses a treatment solution onto the hair, especially rinsing water and/or water loaded with product(s) with a maximum flow rate of less than 4 l/min, the system comprises at least two sources of different products and preferably a means making it possible to select one, the other, or both of the sources of products, the adjustment device makes it possible to adjust the content of each of the products in the treatment solution, especially to adjust the ratio of the two products from 0/100 to 100/0, preferably by steps of 25% or less, the system is configured to make it possible to store in memory at least one setting relating to the two products, the system is configured to generate at least one recommendation of a plurality of catalogue products, especially of a pair of products, based at least on at least one observed treatment result relating to the use of the two products, the system comprises a means making it possible to automatically reproduce the formulation of a treatment solution from data stored in memory relating to a past treatment which used the same formulation of the treatment solution, especially data stored in memory on a removable memory medium or received from a remote server, the system comprises at least one from an anionic surfactant, an amphoteric surfactant, a cationic polymer and a silicone, the user interface makes it possible to input at least one item of information relating to the speed of foaming, the volume of foam, the speed of rinsing, the ease of disentangling, the adjustment device makes it possible to inject, into the water, the product originating from said at least one source of product and to vary the content of product originating from this source in the water conveyed to the hair by the dispensing device and/or the amount of product conveyed to the hair by the dispensing device, this adjustment being able to assume at least one intermediate value between minimum and maximum content and/or amount values, the system comprises a pressure booster to increase the pressure of the water at the inlet of the dispensing device beyond the pressure of the water at the inlet of the system, the dispensing device comprises nozzles arranged so as to cause two jets leaving the dispensing device to collide, the product is injected into the water such that the content of product in the water is between 0.3 and 20% by weight, especially between 0.3 and 10%, the system is configured to automatically vary the content of product according to a predefined program, especially in an increasing or decreasing manner, the system comprises at least two sources of different products, the adjustment device making it possible to selectively vary the proportion of each product in the water dispensed by the dispensing device, the system is arranged to automatically vary the content of each of the products according to a predefined program, the system is configured to adjust the amount of product injected into the water as a function of a flow rate selected by the user in order to obtain a desired concentration, the system is arranged to automatically carry out pre-adjustment of the concentration of product as a function of at least one item of information input into the system by the user, the system is arranged to enable the input of data relative to a result obtained after drying and/or styling the hair, and to automatically propose an optional modification of the setting at the next treatment of the hair as a function of this data, the hair being treated in a sink, the system is configured to control the outlet of this sink, in order especially to open it or to close it as a function of the treatment or rinsing requirement, the system is arranged to automatically vary, according to a predefined program, the content of product and/or the amount of product conveyed to the hair by the dispensing device so as to assume at least two intermediate values between minimum and maximum values, the product is injected into the water upstream of the dispensing device.

Process

Another subject of the invention is a process of treating hair by means of a system according to the invention, in which at least one setting is selected on the user interface and at least one item of information relating to a result obtained with this setting is input to the interface.

In one exemplary embodiment of the invention, a result observed for a given setting is compared with an expected setting by interrogating a database, and at least one product recommendation and/or treatment recommendation is generated as a function of the result of this comparison.

The product recommendation is made for example by comparison with characteristics of catalogue products featured in a database. The recommendation is preferably made after interrogating a database giving information on available stock in the salon.

It is possible to store the setting in memory with a view to a subsequent treatment, and the result observed on the hair and/or a recommendation of a modification of the setting and/or of the product for the subsequent treatment is preferably also stored in memory, as well as preferably an ID for the person treated, the storage and memory taking place especially on a remote server and/or on a removable memory medium.

In order to determine the optimal concentration and/or amount of at least one product used to treat the hair, it is possible, by means of the system according to the invention, to vary the content of at least one product in the water conveyed to the hair, as explained above.

In order to more readily compare the results obtained, it is possible to treat a part of the hair with a given setting, then to modify the setting to treat another part of the hair. It is possible to proceed in this manner with thirds or quarters of the hair, for example.

It is advantageous to store in memory in the system a setting corresponding to a result deemed to be satisfactory, with a view for example to being able to readily reproduce it during the client's next visit. This setting is then advantageously associated with a client ID.

The system may be arranged to automatically vary the amount of a product in the water conveyed to the hair, especially in an increasing manner, and to store in memory an item of information input by the user when the result is deemed to be satisfactory by said user. The user may for example stop the change in the setting when he or she considers the result to be satisfactory, and the system may automatically store the corresponding setting in memory.

Preferably, the opening or the closing of the outlet of the treatment sink is controlled as a function of the nature of the operation taking place, especially the treatment or rinsing operation.

It is possible to test different treatment sequences on different parts of a hair, in order to determine the sequence leading to the result closest to that expected.

At least two sequences may differ by a rinsing duration and/or by the presence or absence of a pre-shampooing operation, a conditioning operation or a rinsing operation.

The process according to the invention may also have at least one of the following characteristics, considered in isolation or in combination:

- a result observed for a given setting is compared with an expected setting by interrogating a database, and at least one product recommendation and/or treatment recommendation is generated as a function of the result of this comparison,
- the product recommendation is made for example by comparison with characteristics of catalog products featured in a database,
- the recommendation is preferably made after interrogating a database giving information on available stock in the salon,
- the setting is stored in memory with a view to a subsequent treatment, and the result observed on the hair and/or a recommendation of a modification of the setting and/or of the product for the subsequent treatment is preferably also stored in memory, as well as preferably an ID for the person treated, the storage in memory taking place especially on a remote server and/or on a removable memory medium,
- a part of the hair is treated with a given setting, then the setting is modified to treat another part of the hair,
- a setting corresponding to a result deemed to be satisfactory is stored in memory,
- the system automatically varies the amount of a product in the water conveyed to the hair, especially in an increasing manner, and stores in memory an item of information input by the user when the result is considered to be satisfactory by said user,
- the opening or the closing of the outlet of the treatment sink is controlled as a function of the nature of the operation taking place, especially the treatment or rinsing operation,
- different sequences of treatments are tested on different parts of a hair,
- at least two sequences differ per one rinsing duration,
- at least two sequences differ by the presence or absence of a pre-shampooing operation, a conditioning operation or a rinsing operation.

BRIEF DESCRIPTION OF THE DRAWINGS

Further features and advantages of the present invention will become apparent from reading the following detailed description of nonlimiting exemplary embodiments thereof and from examining the appended drawing, in which.

DETAILED DESCRIPTION OF THE INVENTION

System

Figure 1:
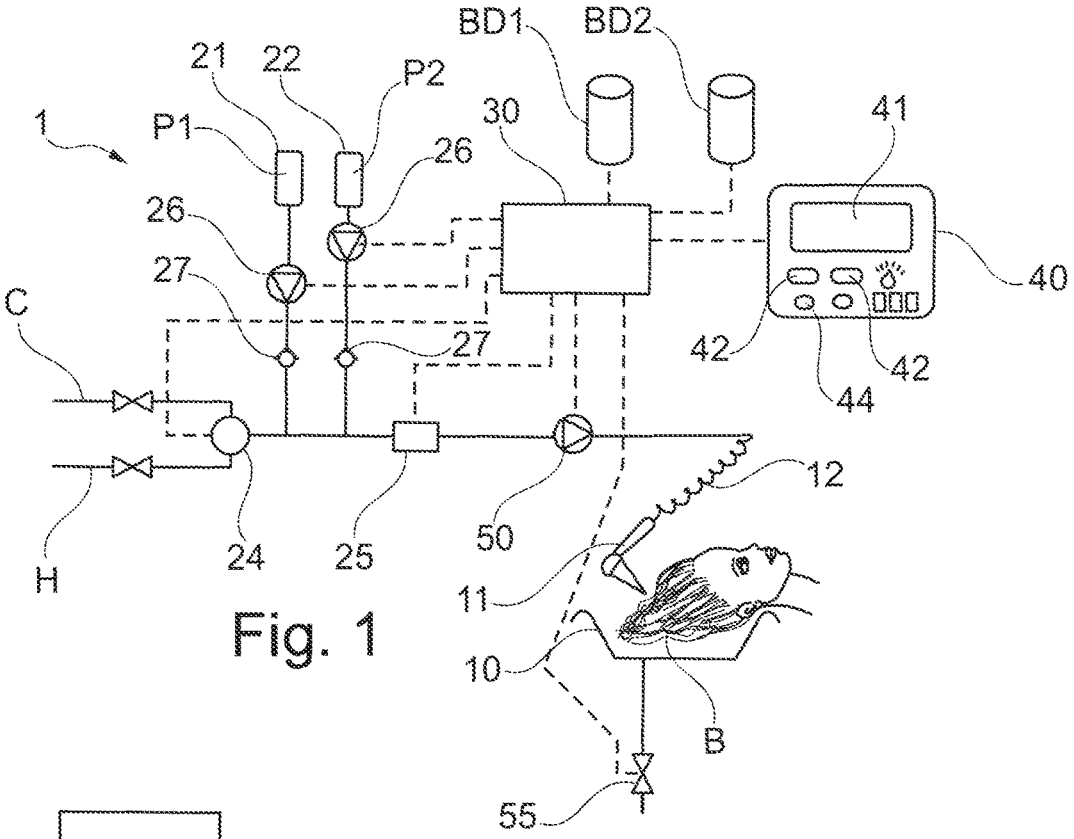
FIG. 1 is a partial schematic representation of an example of a treatment system according to the invention.

FIG. 1 represents a system 1 according to the invention, to be connected to a cold water inlet C and preferably also, as illustrated, to a hot water inlet H.

This system 1 is intended to be used in a hairdressing salon to treat the hair B of a client whose head is positioned over a washing sink 10 which serves to collect the water and the product(s) used to treat the hair. This sink is, as is known per se, connected to an outlet system for waste water. The system 1 comprises a certain number of connectors and pipes which make it possible to convey the water to a dispensing device 11 such as a small shower connected to a flexible hose 12.

In accordance with the invention, the system 1 comprises one or more sources of products for treating the hair, for example two products P1 and P2 in the example in question, contained in respective tanks 21 and 22.

A collection device makes it possible to collect, in a dosed manner, each of the products P1 and P2 with a view to dispensing them via the dispensing device 11. The different products P1, P2 are dosed under the control of an adjustment device 30 comprising, in the example in question, an electronic unit provided with computer means enabling it to communicate with a user interface 40, schematically represented in FIG. 1, and also with one or more databases, in this instance numbering two, with the references BD1 and BD2 in the example in question.

The database BD1 gives information relating to the characteristics of the commercial products, referred to as "catalogue" products, present on the market, and preferably also indicates, from among the products referenced, those which are available in stock in the salon to be sold to clients or available in stock in an online shop which will send the products to the clients. The database BD2 gives information relating to the characteristics of the products used by the system 1.

In a variant embodiment of the invention, the system 1 only comprises a single product and the adjustment device 30 may vary the amount and/or the concentration of this product during the treatment of the hair B.

In the illustrated example, the system 1 comprises temperature control means, such as a mixer 24, controlled by the adjustment device 30, to mix hot water with cold water in order to dispense water with the dispensing device 11 at the desired temperature.

The system 1 may also comprise a flowmeter 25, giving information to the adjustment device 30 relating to the flow rate of the water conveyed to the dispensing device 11, and, by integration, relating to the amount of water dispensed.

The system 1 may also, where appropriate, comprise one or more other sensors, not illustrated, giving information to the adjustment device 30 relating to the amount and/or the flow rate of each of the products conveyed to the dispensing device 11.

In the illustrated example, the products P1 and P2 are collected by means of metering pumps 26, for example of peristaltic type or having a motorized piston, controlled by the adjustment device 30. Nonreturn valves 27 may be present downstream of the pumps 26, these valves 27 opening under the dispensing pressure of the pumps 26.

It may prove beneficial to convey the water to the hair with a low flow rate, by increasing the pressure provided at the dispensing device 11 by means of a pressure booster 50. An example of a dispensing device operating with a low flow rate is disclosed in application WO 2007/062536 A2. The dispensing device then comprises nozzles which direct jets which converge on one another, in order to cause them to break up.

The product(s) used by the system 1 are for example products for treating the hair used during the shampooing thereof, and more generally during a client's session at the sink in the salon. They may be conditioning treatments, masks, shampoos, pre-shampoos or conditioners.

The products may especially comprise anionic surfactants, amphoteric surfactants, cationic polymers and/or silicones. The products may especially comprise sulfate-containing or non-sulfate-containing, nonionic or cationic surfactants, polymers, especially carbon-based or silicone polymers, thickeners, fatty substances such as oils and/or waxes, water and optional solvents.

Each product P1, P2 is preferably contained in a container which is easily connected to the system 1. For example, the system 1 comprises quick connectors, which enables easy replacement of an empty container.

The product(s) may be contained in flexible pouches which deform as they are emptied, so as to enable containers to be emptied without taking up air, for better preservation of said containers.

The initial amount of each treatment product in the corresponding container is for example between 10 ml and 1 liter.

In the example in question, the products P1, P2 are injected into the water which is then conveyed to the dispensing device 11. The adjustment device 30 may control the duration of operation of the pumps 26 and also the flow rate thereof in order to control the amount of product conveyed to the hair B and the flow rate with which the product is injected.

The system 1 may make it possible, by virtue of the user interface 40, to vary the amount of each of the products conveyed to the hair, and also, where appropriate, the concentration of these products in the water which is dispensed by the dispensing device 11.

In variant embodiments, not illustrated, the product(s) are conveyed directly at the dispensing device 11, and the adjustment device 30 controls the amount of each of the products which is dispensed onto the hair by the dispensing device 11. In such an example, the adjustment device 30 then essentially adjusts the amount of each of the products which is conveyed to the hair and not the concentration of the products. It is further possible as a variant to use, as sources of products, the same composition at several concentrations, the products corresponding to these different concentrations being contained in respective containers, and to send the product which corresponds to the selected concentration to the hair by collecting it from the corresponding container.

In another variant embodiment, the system 1 is arranged to carry out pre-mixing of a selected product with water in order to modify the concentration thereof by diluting it, then the result of this mixing is conveyed to the dispensing device 11 via a specific pipe. This makes it possible to avoid diluting each of the products in too great an amount of water and/or improves the dilution of the product in the water, such as, for example, for oil-based products.

As a further variant, the system 1 is arranged to carry out premixing of several products with one another in predetermined ratios in order to produce a mixture to be injected into the water to produce a treatment solution.

The system 1 may further be arranged to convey, to the dispensing device 11, a formula having a ratio between two products, and/or a dilution factor in water of at least one product, which is variable over time and/or as a function of the amount of water dispensed onto the hair. The variation of the ratio(s) may be controlled automatically over time by the system, when executing a test program for example, or be controlled manually by the shampooer.

The system 1 may be arranged to indicate to the shampooer, via the user interface 40, the amount of a product already dispensed onto the hair and/or the amount of product remaining in the corresponding container.

The system 1 may also be arranged to indicate, preferably in real time, the amount of a product remaining to be dispensed and/or to be dispensed during the treatment. The system may be arranged to indicate the amount of water dispensed, and/or the water flow rate, and also the temperature thereof, where appropriate.

All these items of information are, for example, displayed on a screen 41 of the user interface 40.

When the adjustment device 30 has to act on the dilution factor of a selected product, the amount of product which is conveyed by the corresponding pump may be adjusted as a function of the flow rate measured by the flowmeter 25.

The mixture of water and of product or a single product may be conveyed with a flow rate of less than or equal to 4 l/min by the dispensing device 11.

The user interface 40 may be embodied in various ways. Preferably, the user interface 40 is located close to the sink 10, so as to enable the shampooer to modify the treatment parameters and especially to select one or more products to be dispensed onto the hair B and also the amount and/or the content of these products of the water conveyed to the hair. The adjustments are made for example by means of keys 42 making it possible to increase or decrease selection parameters and/or amounts or concentrations.

Where appropriate, the user interface 40 also has a button for setting the temperature of the water, the mixer 24 being for example motorized. As a variant, the system 1 comprises a temperature probe and solenoid valves which make it possible to adjust the flow rate of hot water and of cold water so as to comply with a setpoint temperature.

The user interface 40 may also comprise one or more buttons 44 making it possible to select actions and/or parameters in the menu displayed on the screen 41. In variants, the screen 41 is a touchscreen.

The user interface 40 may further comprise voice recognition and/or be constituted by a terminal of tablet or smartphone type, communicating with the adjustment device 30.

The user interface 40 may receive information transmitted remotely from, for example, a computer of the salon, a tablet or a cell phone.

In one variant, at least part of the user interface 40 is present on the dispensing device 11.

Preferably, the user interface 40 is protected from water splashes and makes it possible to carry out adjustments and/or input information with wet fingers.

The user interface 40 is configured in the described example to enable the shampooer to input one or more items of information relating to the treatment carried out. For example, the shampooer may grade different parameters linked to the use of a product on a predetermined scale of values; for example, the user interface 40 is configured to enable the shampooer to input information relating to the speed of foaming, the volume of foam, the speed of rinsing, the ease of disentangling and/or the effectiveness of cleansing. This information is for example a score, for example a number or a letter, or a symbol, for example of emoticon type.

The user interface 40 may be configured to enable the user to select a pre-recorded and pre-characterized formula. In this case, the system 1 carries out the adjustment which corresponds to the selected formulation.

The user interface may be arranged to enable the user to select a particular test program, with a view, for example, to testing a washing or care product or a particular treatment sequence.

Advantageously, the test program automatically varies at least one treatment parameter, so as to enable the user to test different formulations, for example, on respective parts of the hair. Passing from one test phase to another, with a change in the formulation, for example modification of the concentration of a product or of the amount dispensed, may be indicated by the user interface by emission of a sound and/or visual message; the system may also be arranged to stop and wait for a specific action from the user on a restart button for example, before continuing the test program with the modified formulation.

The adjustment device 30 may comprise a circuit containing a microprocessor or containing a microcontroller and a power interface making it possible to control solenoid valves and/or pumps and/or other motors in order to produce the dosages corresponding to the selected treatment configurations.

Preferably, as illustrated, the adjustment device 30 is arranged to communicate with the databases BD1 and BD2. These databases are, for example, accessible on a computer network of the salon or on a remote server to which the salon is connected, for example via a secure or non-secure Internet connection.

As a variant, the databases BD1 and BD2 are internal to the adjustment device 30, being recorded in a memory thereof. In this case, it is possible to provide, for example, that the adjustment device 30 carries out periodic updates of the information contained in its databases by interrogating a server of the salon or a remote site.

The adjustment device 30 may receive, by virtue, for example, of an analogue and digital interface, signals originating from various sensors, for example of temperature, of pressure and/or of flow rate, and also, where appropriate, signals giving information relating to the filling level of the containers containing the products to be used to treat the hair.

The assembly of the adjustment device 30 may be located close to the washing sink 10, for example in a casing which is sealed against water splashes; as a variant, the adjustment device 30 comprises at least one electronic circuit close to the sink 10 and at least one electronic circuit at a distance, communicating via a wired or wireless connection with the electronic circuit(s) present close to the sink 10.

The system 1 may comprise one or more sensors making it possible to measure at least one characteristic of the hair before cleansing it, for example a comb to be passed through the hair, provided with a microphone or any other sensor which can sense the state of the hair, making it possible to convey a signal representing the state of the hair before treating it. In this case, the adjustment device 30 may be arranged to recommend a setting and/or a choice of products as a function of the evaluation which has been made, making use of reference data for this purpose. The sensor(s) may further be used to evaluate a result of treating the hair by means of the system 1.

In one variant, the system 1 is arranged to display, on the screen 41 of the user interface 40, a questionnaire which the shampooer fills out and, as a function of the results of this questionnaire, to make a suggestion of a setting or of a modification of said setting.

Preferably, the user interface 40 and/or the adjustment device 30 may download data relating to the client whose hair is going to be treated, in order to remind the shampooer of past treatment setting(s), observed result(s) and also the recommended setting(s) for the treatment to be carried out.

The system 1 preferably comprises a means to store at least one setting in memory.

The setting may be stored in memory at the shampooer's request, for example by pressing a button for this purpose on the user interface 40. As a variant, the setting is automatically stored in memory as soon as a treatment result is input. The setting may be stored in memory on a removable memory medium introduced into the adjustment device 30, and/or in a remote database with which the system 1 is in communication.

The system 1 may be configured to control the outlet of the sink 10, by acting, for example, on a solenoid valve 55, in order especially to open it or close it as a function of the treatment or rinsing requirement. For example, when the dispensing device 11 dispenses a product, the outlet is closed so as to enable the user to treat the hair with the amount of water and of product dispensed, the product being in a known amount like the water; once the hair has been treated, the outlet is opened to proceed to the rinsing, for example.

Process

Figure 2:
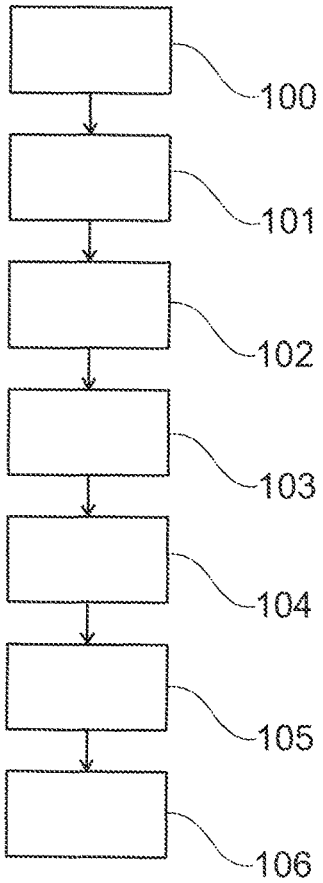
FIG. 2 illustrates various steps of an example of a process according to the invention.

An example of a process for treating the hair according to a first embodiment, making it possible to determine a product in stock to recommend to the client for their personal use, will now be described with reference to FIG. 2.

Firstly, in step 100, the shampooer adjusts the amount of product and/or the concentration of product by virtue of the user interface 40 of the system 1, and may also indicate the choice of product that he or she wishes to use.

As a variant, the shampooer makes the adjustment by adjusting the desired treatment characteristics by virtue of the user interface 40, and the system 1 consults the database BD2 to determine a formula which appears to come close to these criteria.

Adjustment information may be input as mentioned above, following an assessment questionnaire and/or a measurement carried out on the hair of the client whose hair is going to be treated.

It is further possible for the step of selecting the settings to be automatic and to result from downloading data specific to the client whose hair is going to be treated, which data are located for example on a memory medium, such as a USB stick, provided by this client. The data may further be present in a file recorded on their cell phone or downloaded from a database inside the hairdressing salon or outside it.

Downloading data relating to previous treatments undergone by the client may enable the shampooer or the system 1 to propose a setting suggestion when the treatment results observed during previous treatments are not entirely satisfactory.

On the other hand, if the correct settings have been found from previous treatments, for example in terms of products used, amount conveyed to the hair and also, where appropriate, the chronology of use of different products, then the system 1 may simply signal to the shampooer that the setting parameters that the system 1 proposes to use are those which have been considered to be satisfactory during previous treatments, such that the shampooer only has to confirm the proposal made by the system. In order to find the correct settings and/or the correct treatment sequence, the user may have carried out successive tests with the assistance of the system 1 by virtue of pre-existing test programs as described above.

Next, in step 101, the system 1 conveys the selected product(s) to the hair in the concentrations and/or with the amounts selected to carry out the treatment.

A concentration and/or an amount may be adjusted in various ways and for example the shampooer may simply indicate a desired level of strength of the product. For example, the shampooer may select, from the user interface 40, from several degrees such as "less concentrated", "normal concentration", "more concentrated" and the system 1 produces the corresponding dosage.

In step 102, the shampooer may observe the treatment results with regard to one or more criteria and, on the basis of these observations, input information into the system 1 by virtue of the user interface 40.

The shampooer may for example grade the following criteria: speed of foaming, volume of foam, speed of rinsing, ease of disentangling and effectiveness of cleansing, classifying them as "satisfactory", "too high" or "not high enough".

The system 1 may then, in step 103, compare the observed results with the results expected for the applied product by interrogating the database BD2 for the products used by the system, this database BD2 giving information relating to the same criteria as those which are the subject of the evaluation.

The system 1 is therefore able, when at least one of these evaluated criteria is classified as unsatisfactory for a product used, to generate a new suggestion to come close to the result expected with this product.

The system 1 may also weight criteria according to its assumed importance for the client, and propose a product which favors a result deemed to be a priority for a client.

Once the product(s) which make it possible to best treat the hair have been identified, the system may interrogate, in step 104, the database BD1 in order to determine the catalogue product(s) closest to the treatment conditions tested or the treatment conditions which would have made it possible to come close to the expected result.

As a variant, the system 1 is able, when at least one of the criteria is classified as unsatisfactory with the product used, to interrogate the database BD1 in order to determine the catalogue product(s) having adequate characteristics as a function both of the expected results in light of the product and criteria to improve.

The system 1 may also determine, by interrogating the database BD1 or an additional database inside the salon, the product(s) available in stock in the salon, and on the basis of this interrogation provide a product recommendation in step 105.

When none of the products present in the database BD1 is entirely satisfactory in light of the desired criteria, the system 1 may be arranged to advise a product which comes as close as possible to these criteria and give usage advice to improve the action of the product and come close to these criteria. For example, the system 1 may be arranged to deliver usage advice on a product having a slightly inferior disentangling strength to that desired, by carrying out a shorter rinsing. As a variant, the system 1 advises using a product having a slightly inferior disentangling strength to that desired and a weakly dosed disentangling conditioner.

The system 1 may also be arranged to determine a pair of products to recommend to a client for an adequate treatment of their hair.

The system 1 is configured, in the example in question, to record or propose storing in memory, in step 106, a certain amount of data generated when the client is treated. This data may be combined with a client ID, so as to be able to be recovered subsequently, for example when the client's hair is treated again.

The system 1 may be configured to make it possible to determine a succession of two adequate products, such as a pre-shampoo and a shampoo or a shampoo and a conditioner, making it possible to obtain a desired result.

In a variant embodiment of the invention, the shampooer applies different products or products in different concentrations on respective locks of hair, in order to more readily compare the action of these products or setting on the hair.

For example, the shampooer separates the hair into locks of hair and uses one product per lock of hair to compare the action of different products on the hair, with a view to selecting the most suitable product for the hair. The characteristics of the product retained may then be compared to those of catalogue products from the database BD1 in order to determine the product in stock to be recommended to the client. In this case, the characteristics of the products for which information is given in the database BD1 are, for example, amongst other items of information, the contents of the various components of the formula, for example the level of anionic surfactants, of amphoteric surfactants, cationic polymers and of silicones.

Example 1A

In this example, the system 1 has a database BD1 of commercial products available in stores.

This database BD1 gives information, for each product listed therein, on the following usage characteristics:

1) Speed of foaming
2) Speed of rinsing
3) Detergent strength
4) Treatment strength, in this instance disentangling strength.

The system 1 also has a database BD2 giving information on the same usage characteristics for the products integrated into the system 1.

In the example, the database BD1 lists the following products A to D:

A. The product A is a simple shampoo with a composition by weight of LES diluted to 15% (by weight) in water. (Sodium Laureth sulfate with 2 ethylene oxide groups containing 70% active material is supplied by BASF under the trade name Texapon N70).

B. The product B is a treatment shampoo, with a composition by weight of LES diluted to 10%, amphoteric surfactants at 5%, JR 400® polymer of the trade name UCARE™ at 0.5%, in water.

C. The product C is a shampoo referred to as a "sulfate-free" shampoo, heavily concentrated in anionic, amphoteric and nonionic surfactants (shampoo of the trade name Everpure, Pure Color® range, from L'Oreal Paris).

D. The product D is a shampoo based on concentrated nonionic surfactant.

The characteristics of the products A to D indicated in the database BD1 are given in the table below.

| | A | B | C | D |
|---|---|---|---|---|
| Speed of foaming | 3 | 2 | 4 | 2 |
| Volume of foam | 3 | 3 | 5 | 3 |
| Speed of rinsing | 5 | 3 | 3 | 4 |
| Detergent strength | 4 | 2 | 5 | 5 |
| Treatment (disentangling) | 2 | 5 | 4 | 3 |

The value 1 indicates poor performance and the value 5 indicates very good performance.

The shampooer carries out a test on their client with a product X, conveyed into the water of the system 1 and dispensed onto the hair by the dispensing device 11. He or she notes what he or she observes, identifying if the performance is satisfactory, too high or not high enough, classifying them in terms of estimated importance (number 1 corresponding to the least important criterion and number 4 to the most important criterion) for their client. He or she notes the following result:

| | Observation with X |
|---|---|
| 1) Speed of foaming | Sufficient |
| 2) Volume of foam | Sufficient |
| 3) Speed of rinsing | Sufficient |
| 4) Treatment (disentangling) | Insufficient |

The system 1 compares the performance noted by the shampooer relative to the characteristics conventionally expected for the product X in the database BD2.

| | Expected with X |
|---|---|
| Speed of foaming | 3 |
| Volume of foam | 3 |
| Speed of rinsing | 5 |
| Treatment (disentangling) | 3 |

Then, seeing the shortfall in what is deemed to be the main criterion, namely criterion 4) relating to the treatment (disentangling) strength, the system 1 searches in the database BD1 for the product which would be best suited to satisfy this criterion.

It identifies two products, B and C, having a superior treatment strength than that of the tested formula and hence being potential candidates.

The system 1 will identify if the formula B should be chosen since it is the most treating.

As the system knows that, by passing to formula B, the foaming and rinsing speeds will be reduced, the system proposes testing B.

The shampooer then registers the performance. He or she notes that the treatment criterion is adequate but that the foaming (speed of foaming) is insufficient for the hair tested.

The system 1 then proposes the formula C, the treatment performance of which remains good and the foaming strength of which is high. He or she registers the performance, arriving at the conclusion that the formula C is preferred, and inputs this information into the system 1.

The system 1 then deduces two pieces of advice which it proposes to the shampooer:

a) Increase the treatment strength by less rinsing, and/or b) Increase the treatment strength by using a conditioner weakly dosed with cationic surfactant to compensate for the lack of treatment strength.

Process Variant

Figure 3:
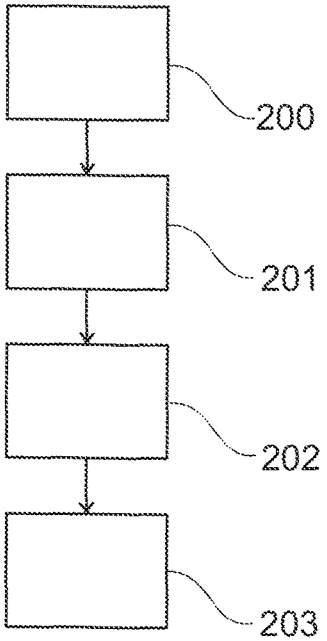
FIG. 3 illustrates various steps of a process variant according to the invention.

A variant of a process for treating the hair will now be described with reference to FIG. 3, which variant makes it possible to more easily adapt the product(s) and/or treatment sequences to the client's hair.

Firstly, in step 200, the shampooer selects, by virtue of the user interface 40, a predetermined test program.

This program may provide for:

- conveying an increasing proportion of a product to the dispensing device 11,
- conveying a variable proportion, especially an increasing or decreasing proportion, automatically or at the shampooer's request, of one product compared to another to the dispensing device 11, or
- conveying, automatically or at the shampooer's request, a plurality of products in a given relative proportion, in an increasing amount relative to the amount of water, to the dispensing device 11.

The system 1 may be configured such that the shampooer may, by pressing a key on the user interface 40, manually give an instruction which causes a change in the concentration of the products relative to one another and/or relative to the water.

In a step 201, the shampooer stops the system 1 when he or she observes that the desired result has been obtained, for example that the product is satisfactorily foaming, caring or washing, and identifies the optimal point. The system 1 may then calculate the amount of each product and of water applied in total, to obtain the result deemed to be optimal.

In a step 202, the system 1 may propose several treatment implementations with the proportions of products and of water determined previously and/or refine the determination of the optimal point.

For example, the system 1 is arranged to propose treatment implementations with a higher flow rate of water and of product to reduce the treatment time and optionally a greater amount of product to take into account the greater proportion of product discharged into the sink 10 due to the higher water flow rate. In order to increase the amount of product, it is possible to increase the product application time and/or to increase the proportion of product.

In a step 203, the shampooer rinses the hair and determines the optimal rinsing as a function of their desire or not to keep or remove traces of product on the hair. The system 1 may be configured to record an optimal rinsing parameter and to associate it with the product.

As a variant, for the optimal point determined previously, the system 1 gives the shampooer information relating to the corresponding optimal rinsing parameters.

The system 1 may also make it possible to test successions of different products to determine the most satisfactory succession of products. For example, the system 1 may be configured to convey one of the following sequences to the dispensing device 11:

- a shampoo, a rinsing solution, especially water, a care product, a rinsing solution,
- a shampoo, a care product, a rinsing solution,
- a pre-shampoo, a rinsing solution, a shampoo, a rinsing solution, a care product, a rinsing solution,
- a pre-shampoo, a shampoo, a rinsing solution, a care product, a rinsing solution,
- a pre-shampoo, a rinsing solution, a shampoo, a care product, a rinsing solution,
- a pre-shampoo, a shampoo, a care product, a rinsing solution,
- a pre-shampoo, a rinsing solution, a shampoo, a rinsing solution,
- a pre-shampoo, a shampoo, a rinsing solution,
- a pre-shampoo, a rinsing solution, a care product, a rinsing solution, or
- a pre-shampoo, a care product, a rinsing solution.

The settings recorded during the optimization of the parameters may be recorded in a client database to be able to be reused during subsequent visits by said client. This makes it possible to gain time during subsequent visits.

Example 1B

In this example, one of the tanks of the system 1 is filled with the following product P1:

- Product P1: "Ultradoux Camomille et miel de fleur®" shampoo from the Garnier brand, comprising anionic and amphoteric surfactants.

At the time of washing the hair, the shampooer adjusts the system to convey 2.5% of product P1 into the water with a flow rate of 1 l/min. He or she then notes the time at which they achieve a good degree of foaming.

On a first model with short hair, 4.5 seconds are needed to achieve a good degree of foaming, which gives approximately 1.87 g of product P1 conveyed. On a second model with a long hair of approximately 35 cm, 8 seconds are needed, which gives approximately 3.33 g of product P1 conveyed. This data is recorded nominally. The shampooer then rinses. He or she notes the time at which the rinsing is obtained satisfactorily: 20 seconds for the first model, i.e. approximately 0.34 l of water, 35 seconds for the second model, i.e. approximately 0.58 l of water.

The following models are recorded:

- Model 1: 1.87 g of product P1 conveyed into the water. Rinsing: 0.34 l. Flow rate=1 l/min
- Model 2: 3.33 g of product P1 conveyed into the water. Rinsing: 0.58 l. Flow rate=1 l/min Subsequently, the system 1 proposes that the shampooer uses the parameters in the following manner in order to reduce the treatment time:

- Model 1: 1.87 g of product P1 conveyed into the water at a flow rate of 1.3 l/min, i.e. 3.45 seconds. Rinsing: 0.34 l of water at a flow rate of 1.3 l/min, i.e. 16 seconds.
- Model 2: 3.33 g of product P1 conveyed into the water at a flow rate of 1.3 l/min, i.e. 6.2 seconds. Rinsing: 0.34 l at a flow rate of 1.3 l/min, i.e. 27 seconds.

If the shampooer subsequently wishes to increase the flow rate, the system 1 recalculates the parameters taking into account any possible losses due to the fact that a portion of the product P1 flows directly into the sink 10 and is discharged directly because of the higher flow rate:

- Model 1: 2.24 g of product P1 conveyed into the water at a flow rate of 1.8 l/min, i.e. 3 seconds. Rinsing: 0.42 l of water at a flow rate of 1.8 l/min, i.e. 14 seconds.
- Model 2: 4 g of product P1 conveyed into the water at a flow rate of 1.8 l/min, i.e. 5.4 seconds. Rinsing: 0.65 l at a flow rate of 1.8 l/min, i.e. 22 seconds.

Example 2B

In this example, the tanks 21 and 22 are filled with the following products P1 and P2:

- Product P1: "Ultradoux Camomille et miel de fleur®" shampoo from the Gamier brand, comprising anionic and amphoteric surfactants,
- Product P2: "Bain Satin 3" shampoo from the Nutritive range from the Kerastase brand At the time of washing the hair, the shampooer adjusts the system 1 to convey 4% of product P1 and 0% of product P2 into the water with a flow rate of 1 l/min. He or she treats a quarter of the hair.

He or she then makes a new adjustment with 2% of product P1 and 2% of product P2. He or she treats a second quarter of the hair.

He or she then makes a new adjustment with 0% of product P1 and 4% of product P2. He or she treats a third quarter of the f hair.

He or she then touches the hair and rinses at a flow rate of 1 l/min. He or she carries out the rinsing with 1 l/min of water for 50 seconds. He or she notes the best touch sensations during rinsing and after rinsing. He or she determines that the best setting is that corresponding to 0% of product P1 and 4% of product P2 which he or she may then store in memory in the system 1 and use subsequently.

Example 3B

In the continuation of example 2B, the shampooer takes the setting he or she had chosen, i.e. 0% of product P1 and 4% of product P2. They reproduce the test from example 2B, but with the following settings:

- 1st quarter hair: 1% of product P1, 3% of product P2,
- 2nd quarter hair: 1.5% of product P1, 2.5% of product P2,
- 3rd quarter hair: 0.5% of product P1, 3.5% of product P2, and
- 4th quarter hair: 0% of product P1, 4% of product P2.

He or she carries out the rinsing with a water flow rate of 1 l/min for 50 seconds.

He or she selects the best setting as a function of the results observed on the different quarter heads of hair, in this instance that corresponding to the third quarter treated, which he or she may then subsequently use.

Example 4B

In the continuation of example 3B, the shampooer takes the setting he or she had previously chosen, namely 0.5% of product P1 and 3.5% of product P2. They reproduce the test from example 2B, but with the following settings:

- 1st quarter: 0.5% of product P1, 3.5% of product P2, 30 seconds of rinsing at 1 l/min,
- 2nd quarter: 0.5% of product P1, 3.5% of product P2, 20 seconds of rinsing at 1 l/min,
- 3rd quarter: 0.5% of product P1, 3.5% of product P2, 10 seconds of rinsing at 1 l/min, and 4th quarter: 0.5% of product P1, 3.5% of product P2, 50 seconds of rinsing at 1 l/min.

After rinsing, he or she touches the hair then dries it. He or she selects the best rinsing operation, which he or she may store in memory in the system 1 and subsequently reproduce.

Example 5B

The shampooer reproduces the example 2B, placing the following products P1 and P2 in the tanks of the system 1:

Product P1: Product concentrated in washing active agent, containing amphoteric surfactants and LES. Sum of 12% and 7% of active material. The amphoteric surfactant is disodium cocoamphodiacetate at 38% in water, and is supplied by Rhodia under the trade name Miranol C2M. The LES (Sodium Laureth sulfate with 2 ethylene oxide groups containing 70% active material, supplied by BASF under the trade name Texapon N70).

Product P2: Product comprising a polymer JR 400® of the trade name UCARE™ concentrated to 5% by weight in water.

The settings that he or she uses are as follows:

1st quarter: 3% of product P1, 0% of product P2,

2nd quarter: 3% of product P1, 0.5% of product P2,

3rd quarter: 3% of product P1, 1.5% of product P2, and

4th quarter: 3% of product P1, 3% of product P2.

After rinsing, he or she touches the hair then dries it. He or she selects the best results, and may store the corresponding ratio of the products P1 and P2 in memory in the system 1 and subsequently reproduce the formulation.

Example 6B

The shampooer reproduces the example 5B, placing the following products P1 and P2 in the tanks:

Product P1: Product concentrated in washing active agent, containing amphoteric surfactants 12/7 and LES.

Product P2: Product comprising amino silicones concentrated to 5% in water.

The settings that he or she uses are as follows:

1st quarter: 3% of product P1, 0% of product P2,

2nd quarter: 3% of product P1, 0.5% of product P2,

3rd quarter: 3% of product P1, 1.5% of product P2, and

4th quarter: 3% of product P1, 3% of product P2.

After rinsing, he or she touches the hair then dries it. He or she selects the best results, and may store the corresponding ratio of the products P1 and P2 in memory in the system 1 and subsequently reproduce the formulation.

Example 7B

The shampooer reproduces the example 5B, placing the following products P1 and P2 in the tanks:

Product P1: Product concentrated in washing active agent, containing amphoteric surfactants 12/7 and LES Product P2: Conditioner comprising a thickened mixture of cationic surfactants and fatty alcohols.

The settings that he or she uses are as follows:

1st quarter: 3% of product P1, 0% of product P2,

2nd quarter: 3% of product P1, 0.5% of product P2,

3rd quarter: 3% of product P1, 1.5% of product P2, and

4th quarter: 3% of product P1, 3% of product P2.

After rinsing, he or she touches the hair then dries it. He or she selects the best results, and may store the corresponding ratio of the products P1 and P2 in memory in the system 1 and subsequently reproduce the formulation.

Example 8B

The shampooer fills a tank with the product P1 as follows:

Product 1: "Ultradoux Camomille et miel de fleur®" shampoo from the Gamier brand, comprising anionic and amphoteric surfactants.

At the time of washing the hair, the shampooer adjusts the system 1 to convey 2.5% of product into the water with a flow rate of 1l/min. He or she applies the solution by means of the dispensing device on four models 1 to 4 with highlighted hair, the highlights of which are especially damaged, for 8 seconds, i.e. approximately 3.3 g of product.

On a first quarter of the hair of each model, he or she carries out rinsing for 10 seconds then applies a conditioner.

On a second quarter, he or she carries out rinsing for 20 seconds then applies a conditioner.

On a third quarter, he or she carries out rinsing for 30 seconds then applies a conditioner.

On a fourth quarter, he or she does not carry out any rinsing, then applies a conditioner.

He or she then rinses all the heads of hair of the models for 40 seconds. After drying, he or she identifies the best situation for each of the models. In this example, for models 1 and 3, the best setting is that with 30 seconds of rinsing. For the model 2, the best settings are those with rinsing of 10 seconds, 20 seconds and 30 seconds, which give equivalent results. For the model 4, the best setting is that with 10 seconds of rinsing, since it leads to a gain in body of the hair. The settings with rinsing for 20 and 30 seconds are satisfactory but do not lead to a gain in body.

Subsequently, the shampooer will be able to store this data in memory in the system 1 and use it to obtain the best setting for the models 1 and 3.

He or she will also be able to offer a short or long rinsing to the model 2, depending on whether or not this model wishes to benefit from a relaxing rinse.

He or she will also be able to offer a short or long rinsing to the model 4, depending on whether or not said model wishes to benefit from a gain in body.

Needless to say, the invention is not limited to the examples that have just been given. For example, while the use of a dispensing device with convergent colliding jets supplied with high pressure is advantageous, the invention is not limited to such a device.

In the example illustrated, the products are injected upstream of the pressure booster 50; in one variant, the injection occurs downstream.

In the case of the use of several products, it is possible to use a single multi-compartment container.

The container(s) may be provided with identifiers which automatically give information to the system 1 relating to the identity of the products and/or relating to the composition and/or the nature of the product contained within. The database BD2 may, where appropriate, automatically update upon reading these identifiers.

It is possible to provide manual-control or automatic-control faucets on the pipes which connect the container(s) of product(s) to the rest of the system 1.

The invention claimed is:

1. A system for treating the hair, to be connected to a water inlet, comprising:

at least one source of a cosmetic product, a water-dispensing device to convey the water, loaded or not with product, to the hair, an adjustment device making it possible to inject, into the water, the product of said at least one source of product and to vary the content of said product in the water conveyed to the hair by the water-dispensing device and/or the amount of product conveyed to the hair by the water-dispensing device, this adjustment assuming at least one intermediate value between minimum and maximum content and/or amount values, a pressure booster to increase the pressure of the water at an inlet of the water-dispensing device beyond the pressure of the water at the inlet of the system, the system being configured to access a database giving information relating to the formulation of catalogue products and to identify one or more catalogue products as a function at least of the knowledge of at least one selected setting and of at least one item of infoimation input by a user relating to an observed treatment result.

2. The system as claimed in claim 1, the water-dispensing device comprising nozzles causing a first jet of water and a second jet of water leaving the water-dispensing device to collide.

3. The system as claimed in claim 1, the content of product injected into the water being between 0.3 and 20% by weight, especially between 0.3 and 10%.

4. The system as claimed in claim 1, being configured to automatically vary the content of product according to a predefined program.

5. The system as claimed in claim 1, comprising at least two sources of different products, the proportion of each product in the water dispensed by the water-dispensing device being selectively varied by the adjustment device.

6. The system as claimed in claim 5, in which the content of each of the products automatically varying according to a predefined program.

7. The system as claimed in claim 1, in which a setting is stored in memory.

8. The system as claimed in claim 1, in which the amount of product injected into the water is adjusted as a function of a flow rate selected by a user to obtain a desired concentration.

9. The system as claimed in claim 1, in which a concentration of product is automatically pre-adjusted as a function of at least one item of information input into the system by the user.

10. The system as claimed in claim 1, in which data relative to a result obtained after drying and/or styling the hair is imputed, and an optional modification of the setting at the next treatment of the hair as a function of this data is automatically proposed.

11. The system as claimed in claim 1, the system comprising a sink, the hair being treated in a the sink, the system being configured to control an outlet of this sink.

12. The system as claimed in claim 1, in which, according to a predefined program, the content of product and/or the amount of product conveyed to the hair by the water-dispensing device is automatically varied so as to assume at least two intermediate values between minimum and maximum values.

13. The system as claimed in claim 1, the injection of the product into the water taking place upstream of the water-dispensing device.

14. A process for the treatment of the hair by means of a system as claimed in claim 1, in which the content of at least one product is varied in the water conveyed to the hair.

15. The process as claimed in claim 14, in which a part of the hair is treated with a given setting, then the setting is modified to treat another part of the hair.

16. The process as claimed in claim 14, in which a setting corresponding to a result deemed to be satisfactory is stored in memory.

17. The process as claimed in claim 14, in which the system automatically varies the amount of a product in the water conveyed to the hair and stores in memory an item of information input by a user when the result is considered to be satisfactory by said user.

18. The process as claimed in claim 14, in which the hair being treated in a treatment sink, opening or closing of the outlet of the treatment sink is controlled as a function of the nature of the operation taking place.

19. The process as claimed in claim 14, in which different sequences of treatments are tested on different parts of a hair.

20. The process as claimed in claim 19, at least two sequences differing per one rinsing duration.

21. The process as claimed in claim 19, at least two sequences differing by the presence or absence of a pre-shampooing operation, a conditioning operation or a rinsing operation.

22. The system as claimed in claim 1, the hair being treated in a sink, the system being configured to open or close an outlet of this sink as a function of the treatment or rinsing requirement.

23. A system for treating the hair, to be connected to a water inlet, comprising:

at least one source of a cosmetic product;

a water-dispensing device to convey the water, loaded or not with product, to the hair;

an adjustment device making it possible to inject, into the water, the product of said at least one source of product and to vary the content of said product in the water conveyed to the hair by the water-dispensing device and/or the amount of product conveyed to the hair by the water-dispensing device, this adjustment assuming at least one intermediate value between minimum and maximum content and/or amount values; and a pressure booster to increase the pressure of the water at an inlet of the water-dispensing device beyond the pressure of the water at the inlet of the system, wherein data relative to a result obtained after drying and/or styling the hair is imputed, and an optional modification of the setting at the next treatment of the hair as a function of this data is automatically proposed.

24. A process for the treatment of the hair by means of a system for treating the hair, to be connected to a water inlet, comprising:

at least one source of a cosmetic product;

a water-dispensing device to convey the water, loaded or not with product, to the hair;

an adjustment device making it possible to inject, into the water, the product of said at least one source of product and to vary the content of said product in the water conveyed to the hair by the water-dispensing device and/or the amount of product conveyed to the hair by the water-dispensing device, this adjustment assuming at least one intermediate value between minimum and maximum content and/or amount values; and a pressure booster to increase the pressure of the water at an inlet of the water-dispensing device beyond the pressure of the water at the inlet of the system, wherein the content of at least one product is varied in the water conveyed to the hair, and wherein the system automatically varies the amount of a product in the water conveyed to the hair and stores in memory an item of information input by the user when the result is considered to be satisfactory by said user.

* * * * *